US005152509A

United States Patent [19]

Wells et al.

[11] Patent Number: 5,152,509

[45] Date of Patent: Oct. 6, 1992

[54] BEDDING FOUNDATION HAVING SNAP-IN PLACE MODULAR WIRE SPRINGS

[75] Inventors: Thomas J. Wells; Steven E. Ogle, both of Carthage, Mo.

[73] Assignee: Leggett & Platt, Incorporated, Carthage, Mo.

[21] Appl. No.: 543,678

[22] Filed: Jun. 22, 1990

[51] Int. Cl.[5] ..... F16F 3/04

[52] U.S. Cl. ..... 267/103; 5/247; 5/255; 267/107

[58] Field of Search ..... 267/81, 102, 103, 105, 267/106, 144, 107, 108, 109, 110, 111, 112, 80, 86, 85, 100; 5/247, 255, 267, 476, 246, 254, 260, 268, 261, 277

[56] References Cited

U.S. PATENT DOCUMENTS 3,574,240 4/1971 Slominski ..... 267/107 X
4,619,445 10/1986 Sasaki ..... 267/103 X
4,685,659 8/1987 Hagemeister ..... 267/103
4,862,531 9/1989 Wells ..... 267/103 X
4,862,532 9/1989 Wells et al. .
4,896,386 1/1990 Ogle et al. .

*Primary Examiner*—Douglas C. Butler
*Attorney, Agent, or Firm*—Wood, Herron & Evans

[57] ABSTRACT

A box spring assembly includes a base frame, a top wire grid and a plurality of modular wire springs interconnecting the top wire grid and the base frame. The modular wire springs each comprises a unitary wire formed into an inverted U-shaped configuration with the closed end of each U-shaped spring having two edge connector bars and a diagonally extending central connector bar interconnected at its opposite ends to the edge connector bars by attachment segments. The closed end of the modular spring is snap-fit to the top wire grid so each of the edge connector bars supports separate portions of the top wire grid at intersections within the wire grid. The vertical legs of the modular spring include at least three torsion bars and two edge loops of differing radii. The edge loops, because of their differing radii impart differing softness or deflection characteristics to the modular springs.

14 Claims, 3 Drawing Sheets

BEDDING FOUNDATION HAVING SNAP-IN PLACE MODULAR WIRE SPRINGS

FIELD OF THE INVENTION

This invention relates to bedding foundations, and more particularly, to a box spring style of bedding foundation.

BACKGROUND OF THE INVENTION

Box springs or bedding foundations have traditionally included coil springs positioned in a vertical orientation so as to provide resilient support for a bedding mattress. In an effort to improve upon these conventional coil spring types of box spring or bedding foundation assemblies, numerous prior art assemblies have been developed which substitute modular wire springs for the more traditional coil springs. "Modular wire" springs is a term of art used to describe springs which derive their resiliency from torsion bars or configurations other than coils. Examples of modular wire springs embodied in box spring assemblies are to be found in U.S. Pat. Nos. 3,825,960; 3,833,948; and 3,835,485. Additionally, some prior art box spring assemblies have been developed which include combinations of coil and modular wire springs, as for example, the box spring assembly shown in U.S. Pat. No. 3,990,121. In those instances wherein modular wire springs and coil springs have been combined in a box spring, the modular wire springs have usually functioned to impart additional firmness to selected areas of the box spring, as for example, around the edge of the box spring or in the center section of the box spring.

A limitation of modular wire springs has been the relative smallness of the area of the top rectangular grid supported by the modular wire spring. A larger support area for the rectangular grid would improve the overall support provided by the box spring assembly.

One problem associated with some modular wire springs is the lack of resiliency and softness of the support provided by the spring, particularly upon initial deflection of the springs. Modular wire springs are very resilient, i.e., bounce back from deflection, but do not provide the relatively soft support or deflection characteristics achievable by coil springs. What is needed is a spring which has the softness or feel of coil springs in a resilient modular wire spring.

It has therefore been an objective of this invention to provide an improved box spring with greater support for a larger area of the top rectangular grid.

Still another objective of the present invention has been to provide a modular wire spring that maintains the resiliency of previously known modular wire springs while providing softer resilient support.

SUMMARY OF THE INVENTION

The improved box spring of this invention comprises a top wire grid and a base frame interconnected by a plurality of modular springs. Each modular spring comprises a flat, horizontal, head section having two parallel edge connector bars attached to opposing ends of a diagonally extending central connector bar by two attachment segments. Each attachment segment has an offset section formed therein. In order to lock the spring within a rectangular pocket of the grid, each edge connector bar passes beneath both a longitudinal and transverse grid wire at one corner of the pocket within which a spring is snap-fit and each offset section of the two attachment segments are urged over parallel longitudinally extending wires of the rectangular pocket. The frictional fit of the attachment segment and the longitudinally extending grid wires over which they are located prevents the flat, horizontal head of the spring from sliding horizontally and inadvertently releasing from the pocket into which it is snap-fit. Since each edge connector bar passes beneath both a transversely and longitudinally extending grid wire at one corner of the grid, the modular spring provides exceptionally good support of the grid at more points along the pocket than prior modular springs.

A pair of resilient legs extend downwardly from the flat horizontal head section of each modular spring. Each of the vertical legs comprises at least three parallel horizontal torsion bars interconnected by two edge loops. The edge loops differ substantially in radii so as to impart differing deflection characteristics to the spring. Specifically, one edge loop is substantially larger in radii than the other edge loop of the same leg so that the larger radius loop deflects before the smaller loop and thereby renders the spring initially soft. When the larger radius loop is sufficiently deflected, it becomes harder or more firm and the second smaller radii loop begins to deflect. Thereby, these differing radii loops contribute to the initial softness without loss of resiliency in the bedding foundation constructed according to the principles of the invention.

These and other objects and advantages of the present invention will be more readily apparent from the following description of the drawings, in which.

Figure 1:
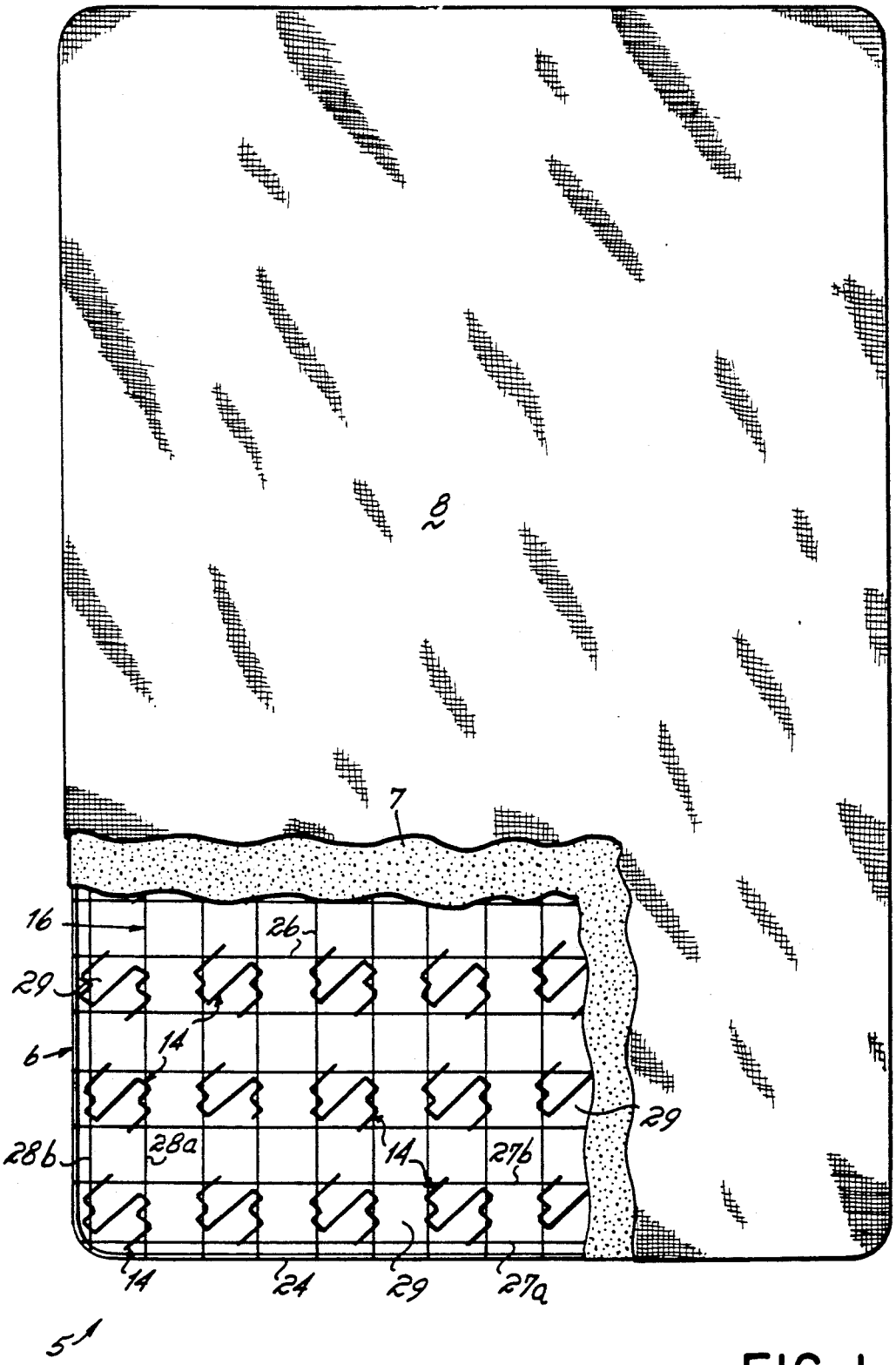
FIG. 1 is a top plan view, partially broken away, of a box spring incorporating the invention of this application.
Figure 2:
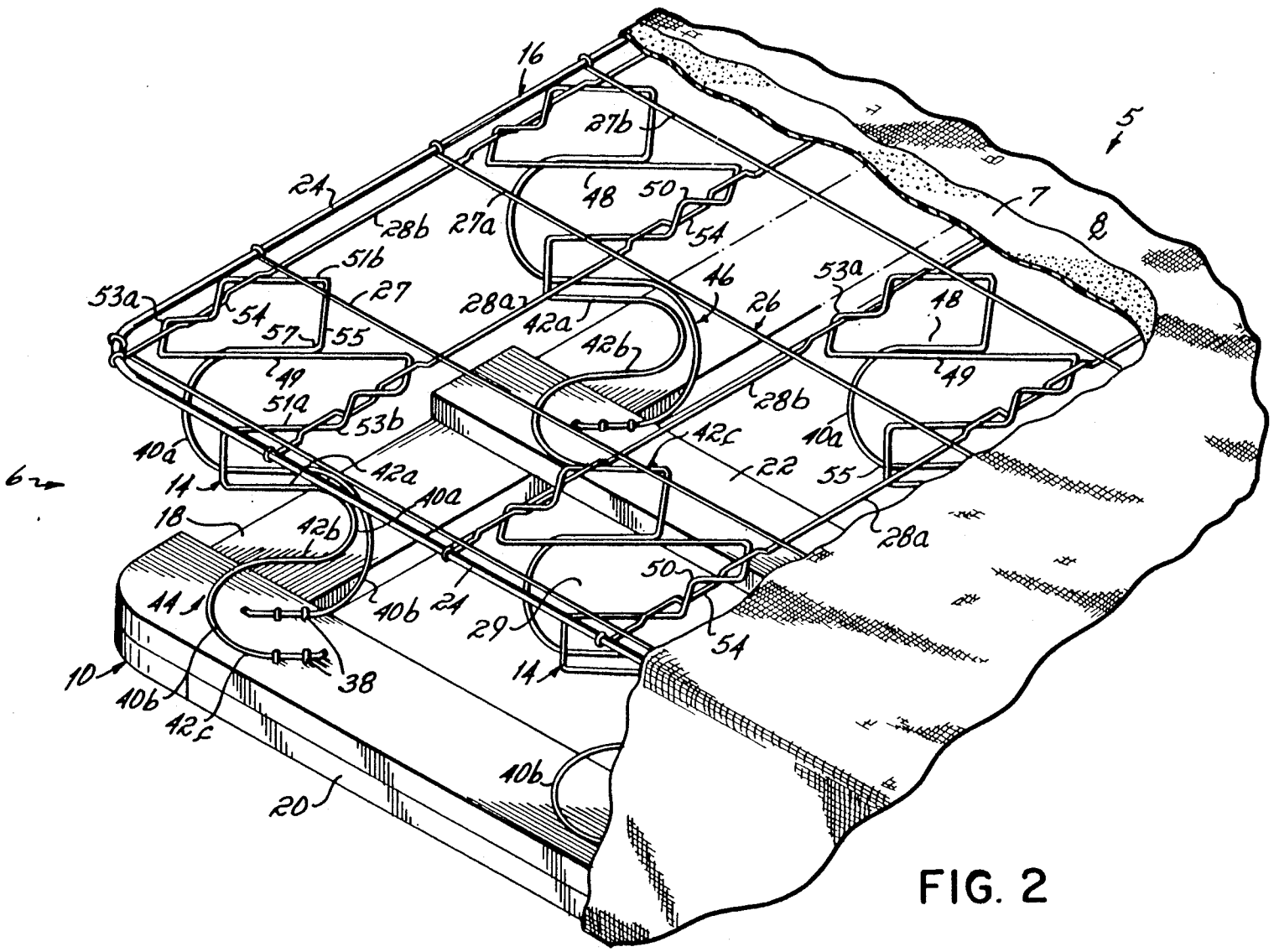
FIG. 2 is a perspective view of one corner portion of the box spring assembly of FIG. 1.

With reference first to FIGS. 1 and 2, it is seen that the bedding foundation or box spring 5 of this invention includes a box spring assembly 6 over the top of which padding 7 is placed. The box spring assembly 6 and padding 7 are encased in an upholstered covering 8.

The box spring assembly 6 of FIG. 2 comprises a wooden base frame 10 upon the top of which there is mounted a plurality of modular wire springs 14 for supporting a top wire grid 16. The top wire grid 16 is intended to resiliently support a mattress, as is conventional in the bedding industry.

The base frame 10 is rectangular in configuration and comprises a pair of longitudinally extending side boards 18 (FIG. 2), as well as a pair of transversely extending end boards 20, nailed or otherwise secured to the top of the side boards 18. Additionally, there are a plurality of wooden slats 22 which extend transversely across the rectangular base between the side boards 18. These slats are also nailed or otherwise fixedly secured to the top of the side boards 18.

The top wire grid assembly 16 of FIG. 2 comprises a border wire 24 and a wire grid 26. The border wire 24 is formed into a rectangular configuration and overlies the peripheral edge of the rectangular base frame. The wire grid 26 is secured to and located in the plane of the border wire 24, the grid and border wire defining the top plane of the box spring assembly. The wire grid 26 comprises a plurality of spaced, transverse wires 27 and a plurality of spaced, longitudinal wires 28. The transverse wires 27 are arranged in pairs 27*a*, 27*b*, and the longitudinal wires 28 are similarly arranged in pairs 28*a*, 28*b*. All of the wires 27 and 28 of the wire grid 26 extend between opposite sides and ends, respectively, of the rectangular border wire 24. These grid wires overlie the rows and columns of formed wire springs or modular springs 14 so as to secure the top of those springs 14 against lateral and longitudinal displacement. The edgemost ones of the transverse wires 27 and longitudinal wires 28 lie in close adjacency and parallel to the border wire so as to provide edge support of the border wire from the springs 14 which are snap-fit into pockets of the wire grid defined by these edgemost wires as explained more fully hereinafter.

The ends of all the grid wires 27, 28 are hooked around the border wire 24 and are preferably welded to the border wire. The intersections or cross-over points of the transverse wires 27 and the longitudinal wires 28 are preferably welded to provide a matrix of pockets 29 contained within an integral wire top grid. In manufacture, the border wire 24 and the wire grid 26 are all preformed into a top wire grid 16 subassembly.

Figure 3:
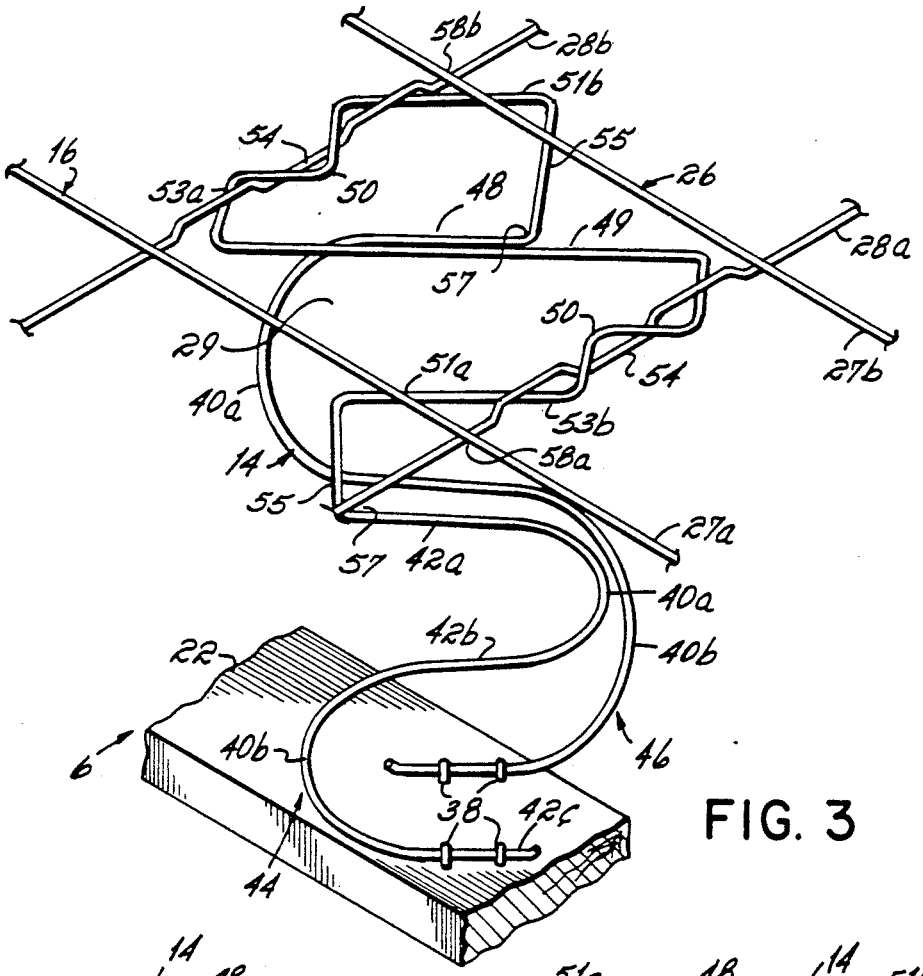
FIG. 3 is an enlarged perspective view of one portion of the box spring assembly of FIG. 2.
Figure 4:
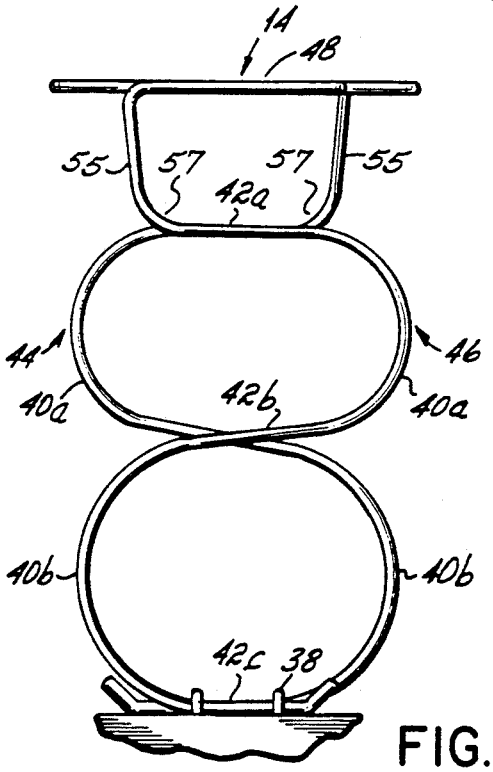
FIG. 4 is a side elevational view of one spring module of the box spring assembly illustrated in FIG. 1.

The top wire grid 16 is connected to the wooden frame by the modular wire springs 14. With particular reference to FIGS. 2 and 3, it is seen that each of these modular wire springs 14 comprises a unitary wire spring strip having a flat, horizontal, top section or head 48 and a pair of substantially vertical legs 44, 46. Each vertical leg 44, 46 is formed by a pair of edge loops 40*a* and 40*b*, three torsion bars 42*a*, 42*b* and 42*c*, and a vertical connector bar 55. Each vertical leg 44 is a mirror image of the other vertical leg 46 of the spring 14 as shown in FIGS. 3 and 4. The two edge loops 40*a* and 40*b* of each vertical leg are interconnected by the middle straight torsion bar 42*b*. The uppermost edge loop 40*a* is connected at its upper end to one end of torsion bar 42*a*. The other end of torsion bar 42*a* is joined to the vertical connector bar 55 by a sharply radiused curved portion 57 of a vertical segment 55 that joins vertical leg 44 to flat head section 48. The second edge loop 40*b* is connected at its lower end to the torsion bar 42*c*. The bottommost torsion bar 42*c* is connected to the base frame 10 by staples 38.

The substantially flat, top section or head 48 of each spring comprises a central connector bar 49 and a pair of parallel edge connector bars 51*a* and 51*b*. Attachment segments 53*a* and 53*b* connect one end of each edge connector bar to opposite ends of the central connector bar 49. The opposite ends of the edge connector bars 51*a* and 51*b* are connected to the vertical connector bars 55 on each of the vertical legs 44 and 46. In the practice of this invention, the attachment segments 53*a* and 53*b* each have an inwardly extending offset 50 formed therein.

Figure 5:
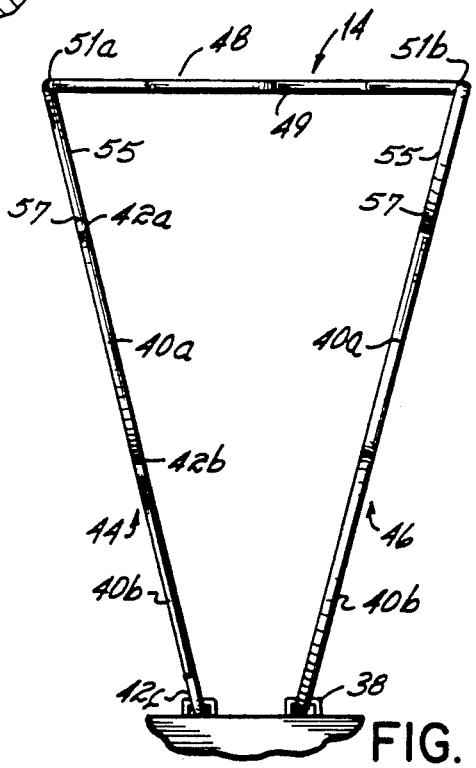
FIG. 5 is a front elevational view of the spring module of FIG. 4.

In the preferred practice of this invention, each vertical leg is displaced from a vertical plane by approximately 15° as best illustrated in FIG. 5. In other words, both legs 44, 46 slope inwardly from the edge connector bars 51 toward one another to the point of attachment with the base frame.

At the top, all of the springs 14 are attached to the grid 16 by having the substantially flat or planar top sections 48 of the springs snap-fit into pockets 29 of the grid defined by intersecting pairs of transverse wires 27*a*, 27*b* and longitudinal wires 28*a*, 28*b*. To facilitate this snap-fit interconnection of the top sections 48 of the springs 14 within the pockets 29 of the wire grid, it will be noted in FIGS. 2 and 3 that the longitudinal wires 28 pass under the transverse wires 27 at the intersections thereof. It will also be noted that the longitudinal wires of each spring module receiving pocket 29 are bent or offset upwardly between each pair of transversely extending wires. The upward offset is approximately equal to the diameter of the wire from which the spring module is formed. Approximately medially of the upwardly offset portions of the longitudinal wires 28, the wires are bent or offset downwardly for approximately the middle third of the length of pocket defining portion of the longitudinal wires. This downward offset 54 is also equal to approximately the diameter of its module spring wire. Otherwise expressed, the pocket defining portions of each longitudinal wire of the grid is offset upwardly in the outer two thirds of the pocket and offset downwardly in the center one third.

When the flat planar head 48 of the springs are snap-fitted into place in the pockets 29 of the grid, each edge connector bar 51*a*, 51*b* passes beneath both a transverse wire 27 and longitudinal wire 28 at the intersection of the two wires or at the corner of a pocket. As shown in FIG. 3, edge connector 51*b* supports or passes beneath wires 27*b* and 28*b* at intersection 58*b* while edge connector 51*a* passes beneath and supports wires 27*a* and 28*a* at intersection 58*a* at the diagonally opposed corner of rectangular pocket 29. Support of both transverse and longitudinal wires at opposing intersections or corners of the rectangular pockets in grid 16 provides box spring 5 with very good support of the grid of the box spring.

To assemble the springs 14 with the grid 16, the flat head section 48 of a spring 14 is snap-fit into a pocket 29 of the grid by first locating one offset 50 of an attachment segment 53 within the indentation or offset 54 of the longitudinal wire 28*a* which partially defines pocket 29. The central connector bar 49 diagonally extends from one corner of pocket 29 to another in this position. The other offset portion 50 of the other attachment segment 53 is then located beneath the indentation or offset 54 of the opposing longitudinal wire 28*b*. The offset 50 is then pulled or forced outwardly until the portion 50 of the head snaps over the indentation or offset 54 in the opposing wire 28*b* to snap-fit flat head 48 of spring 14 into pocket 29 of wire grid 16. The spring is now fixedly attached to the wire grid.

In practice, the box spring of FIGS. 1–3 is assembled by first nailing the end boards 20 to the tops of the side boards 18 and by nailing the slats 22 to the tops of these same side boards. The preassembled top wire grid 16 having the springs 14 mounted therein is then fitted over the top of the assembled wooden frame so as to position the bottom section torsion bars 42*c* of the formed or modular wire springs 14 atop the base frame. The bottom, free end of torsion bars 42*c* of the wire springs 14 are then stapled to the tops of the end boards 20 and the ends of the slats 22.

It is important to note that the edgemost longitudinal and transverse grid wires which partially define the pockets 29 for the edgemost springs 14, are located closely adjacent the border wire 24. In practice, these edgemost grid wires extend parallel to the grid wire but are spaced approximately two centimeters from the border wire 24. The need for this close adjacency positioning of the edgemost grid wires derives from the fact that the border wire is made from such heavy gauge or large diameter wire or rod that it is not suitable for snap-fit connection with the edgemost springs 14. By locating the edgemost grid wires in close adjacency, but spaced from, the border wire, the springs 14 may be snap-fit thereto while still providing vertical edge support for the closely spaced border wire. The edgemost grid wires thus act as an inner border wire extending parallel to, but slightly spaced from, the border wire 24, but of much smaller diameter wire suitable for snap-fit connection with the top flat section of the springs 14.

To complete the foundation after completion of the box spring assembly, the fabric pad 7 is overlaid over the top of the wire grid and the complete assembly, including the rectangular wooden frame, the springs, the top wire grid, and the fabric pad, are enclosed within the upholstered covering 8.

While we have described only one preferred embodiment of our invention, persons skilled in this art will appreciate changes and modifications which may be made without departing from the spirit of our invention. For example, the relative positioning of the snap-fit modular wire springs in the box spring assembly may be varied without departing from our invention, or those modular wire springs may be mixed with coil springs or other modular springs at selected sites in the assembly. Therefore, we do not intend to be limited except by the scope of the following appended claims.

We claim:

1. A bedding foundation comprising, a bottom, substantially rectangular, base frame having side and end members and slats extending between said side members, a substantially planar, horizontal, rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first and second sets of wires intersecting one another and being connected to said border wire, pairs of said longitudinally extending wires and pairs of said transversely extending wires defining a plurality of rectangular pockets, a plurality of modular wire springs interconnecting said base frame and said wire grid, each of said modular wire springs comprising a single length of wire, said length of wire being formed into a pair of substantially vertical resilient legs having first and second ends, said pair of substantially, vertical resilient legs being interconnected by a flat, horizontal, head section, said flat head section of each of said modular wire springs being secured within one of said pockets of said wire grid and said first ends of said vertical legs of each of said modular springs being remote from said flat head section and being fixedly secured to said base frame, said flat, horizontal, head section of each of said modular wire springs including a pair of edge connector bars and a central connector bar, said central connector bar having first and second ends, said first end of said central connector bar being connected to one of said edge connector bars by a first attachment segment and said second end of said central connector bar being connected to the other said edge connector bar by a second attachment segment, said flat, horizontal, head section being connected to said top wire grid by snap-fit connector means, said snap-fit connector means comprising portions of each of said edge connector bars underlying both one of said longitudinally extending, spaced, parallel wires and one of said transversely extending, spaced, parallel wires at diametrically opposite corners of one of said rectangular pockets of said grid and first portions of said first and second attachment segments being located over portions of one of said pairs of said longitudinally extending wires and one of said pairs of said transversely extending wires defining one of said rectangular pockets and second portions of said first and second attachment segments being located beneath other portions of said one of said pairs of said longitudinally extending wires and said one of said pairs of said transversely extending wires defining said one of said rectangular pockets, a fabric pad overlying said top wire grid, and an upholstered covering surrounding said base frame, top wire grid, modular wire springs, and said fabric pad.

2. The bedding foundation of claim 1 wherein said central connector bar is parallel to and disposed between said edge connector bars.

3. A bedding foundation comprising.

a bottom, substantially rectangular, base frame having side and end members and slats extending between said side members, a substantially planar, horizontal, rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first and second sets of wires intersecting one another and being connected to said border wire, pairs of said longitudinally extending wires and pairs of said transversely extending wires defining rectangular pockets, a plurality of modular wire springs interconnecting said base frame and said wire grid, each of said modular wire springs comprising a single length of wire, said length of wire being formed into a pair of substantially vertical resilient legs having first and second ends, said substantially vertical resilient legs being interconnected by a flat, horizontal, head section, said flat head section of each of said modular wire springs being secured within one of said pockets of said wire grid and said first ends of said vertical legs of each of said modular springs being remote from said flat head section and being fixedly secured to said base frame, said flat, horizontal, head section of each of said modular wire springs including a pair of edge connector bars and a central connector bar, said flat, horizontal, head section of each of said modular wire springs including a pair of edge connector bars and a central connector bar, said central connector bar having first and second ends, said first end of said central connector bar being connected to one of said edge connector bars by a first attachment segment and said second end of said central connector bar being connected to the other said edge connector bar by a second attachment segment, said flat, horizontal, head section being connected to said top wire grid by snap-fit connector means, said snap-fit connector means comprising portions of each of said edge connector bars underlying both one of said longitudinally extending, spaced, parallel wires and one of said transversely extending, spaced, parallel wires at one corner of one of said rectangular pockets of said grid and first portions of said first and second attachment segments being located over portions of one of said pairs of said longitudinally extending wires and one of said pairs of said transversely extending wires defining one of said rectangular pockets and second portions of said first and second attachment segments being located beneath other portions of said one of said pairs of said longitudinally extending wires and said one of said pairs of said transversely extending wires defining said one of said rectangular pockets.

4. A bedding foundation comprising, .

a bottom, substantially rectangular, base frame having side and end members and slats extending between said side members, a substantially planar, horizontal, rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first and second sets of wires intersecting one another and being connected to said border wire, pairs of said longitudinally extending wires defining rectangular pockets, a plurality of modular wire springs interconnecting said base frame and said wire grid, each of said modular wire springs comprising a single length of wire, said length of wire being formed into a pair of substantially vertical resilient legs having first and second ends, said pair of substantially vertical resilient legs being interconnected by a flat, horizontal, head section, said flat head section of each of said modular wire springs being secured within one of said pockets of said wire grid and said first ends of said vertical legs of each of said modular springs being remote from said flat head section and being fixedly secured to said base frame, each of said substantially vertical legs of said modular wire springs comprising an upper and a lower edge loop and three torsion bars, said upper edge loop having an upper end and a lower end, said upper end of said upper edge loop being connected to a first one of said three torsion bars, said lower end of said upper edge loop being connected to a second one of said three torsion bars, said lower edge loop having an upper end and a lower end, said upper end of said lower edge loop being connected to said second one of said three torsion bars and said lower end of said lower edge loop being connected to a third one of said three torsion bars, said third one of said three torsion bars of each substantially vertical leg being connected to said base frame and said first one of said three torsion bars of each substantially vertical leg being connected by a vertically extending section from each said substantially vertical leg to said flat, horizontal, head section of each of said modular wire springs, and said upper and said lower edge loops being of differing radii so as to impart differing load deflection characteristics to said modular springs.

5. The bedding foundation of claim 4 wherein said vertically extending section of each of said substantially vertical legs includes a vertical connector bar, said vertical connector bar having an upper end and a lower end, said upper end of said vertical connector bar being connected to said flat, horizontal, head section and said lower end of said vertical connector bar being connected by a curved portion to said first one of said three torsion bars.

6. The bedding foundation of claim 5 where said upper edge loop, said lower edge loop and said curved portion of said vertical connector bar all have differing radii.

7. The bedding foundation of claim 4 wherein each edge connector bar of said flat, horizontal, head section has a portion underlying both one of said longitudinally extending, spaced, parallel wires and one of said transversely extending, spaced, parallel wires at one corner of one of said rectangular pockets.

8. A modular spring adapted to fit within a wire grid having a first set of transversely extending wires and a second set of longitudinally extending wires that define a plurality of rectangular pockets comprising, a single length of wire, said length of wire being formed into a pair of substantially vertical resilient legs interconnected by a flat, horizontal head section, said flat, horizontal, head section including a pair of edge connector bars and a central connector bar, said central connector bar having first and second ends, said first end of said connector bar being connected to one of said edge connector bars by a first attachment segment and said second end of said connector bar being connected to the other said edge connector bar by a second attachment segment, said flat, horizontal, head section having snap-fit means connectors to snap-fit said flat, horizontal head section within one of said rectangular pockets, said snap-fit connector means comprising portions of each of said edge connector bars underlying both one of said longitudinally extending wires and one of said transversely extending wires at diametrically opposite corners of one of said rectangular pockets of said wire grid and first portions of said first and second attachment segments being located over portions of one of said transversely extending wires and one of said longitudinally extending wires defining one of said rectangular pockets and other portions of said first and second attachment segments being located beneath other portions of said one of said transversely extending wires and said one of said longitudinally extending wires defining said one of said rectangular pockets.

9. The modular spring of claim 8 wherein said central connector bar is parallel to and disposed between said edge connector bars.

10. A modular spring adapted to fit within one pocket of a plurality of pockets formed in a wire grid by a set of longitudinally extending, spaced, parallel wires and a set of transversely extending, spaced, parallel wires, comprising, a single length of wire, said length of wire being formed into a pair of substantially vertical resilient legs interconnected by a flat, horizontal, head section, said flat head section being adapted to be secured within one of said pockets of said wire grid, each of said substantially vertical legs comprising an upper and a lower edge loop and three torsion bars, said upper edge loop having an upper and lower end, said upper end of said upper edge loop being connected to a first one of said three torsion bars, said lower end of said upper edge loop being connected to a second one of said three torsion bars, said lower edge loop having an upper and a lower end, said upper end of said lower edge loop being connected to said second one of said three torsion bars and said lower end of said lower edge loop being connected to a third one of said three torsion bars, said third one of said three torsion bars of each substantially vertical leg being connected to said base frame and said first one of said three torsion bars of each substantially vertical leg being connected by a vertically extending section from each said substantially vertical leg to said flat, horizontal, head section of said modular wire spring, and said upper and lower edge loops being of differing radii so as to impart differing load deflection characteristics to said modular spring.

11. The modular spring of claim 10 wherein said vertically extending section connected to said first one of said three torsion bars includes a vertical connector bar, said vertical connector bar having an upper end connected to said flat, head section and a lower end connected by a curved portion to said first one of said three torsion bars.

12. The modular spring of claim 11 wherein said upper edge loop, said lower edge loop and said curved portion of said vertical connector bar all have differing radii.

13. The modular spring of claim 10 wherein each edge connector bar has a portion underlying both one of said longitudinally extending wires and one of said transversely extending wires defining one of said rectangular pockets at one corner of said one rectangular pocket.

14. A bedding foundation comprising, a bottom, substantially rectangular, base frame having side and end members and slats extending between said side members, a substantially planar, horizontal, rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first and second sets of wires intersecting one another and being connected to said border wire, pairs of said longitudinally extending wires and pairs of said transversely extending wires defining a plurality of of rectangular pockets, a plurality of modular wire springs interconnecting said base frame sand said wire grid, each of said modular wire springs comprising a single length of wire, said length of wire being formed into a pair of substantially vertical resilient legs having first and second ends, said pair of substantially, vertical resilient legs being interconnected by a flat, horizontal, head section, said flat head section of each of said modular wire springs being secured within one of said pockets of said wire grid and said first ends of said vertical legs of each of said modular springs being remote from said flat head section and being fixedly secured to said base frame, said flat, horizontal, head section of each of said modular wire springs, including a pair of edge connector bars and a central connector bar, said central connector bar having first and second ends, said first end of said central connector bar being connected to one of said edge connector bars by a first attachment segment and said second end of said central connector bar being connected to the other said edge connector bar by a second attachment segment, said edge connector bars and said central connector bar being substantially parallel, said flat, horizontal, head section being connected to said top wire grid by snap-fit connector means, said snap-fit connector means comprising portions of each of said edge connector bars underlying both one of said longitudinally extending, spaced, parallel wires and one of said transversely extending, spaced, parallel wires defining one of said rectangular pockets at diametrically opposite corners of said one of said rectangular pockets of said grid and first portions of said first and second attachment segments being located over portions of said one of said transversely extending wires and said one of said longitudinally extending wires defining said one of said rectangular pockets and second portions of said first and second attachment segments being located beneath other portions of said one of said transversely extending wires and said one of said longitudinally extending wires defining said one of said rectangular pocket.

* * * * *